US006318274B1

(12) United States Patent
Park

(10) Patent No.: US 6,318,274 B1
(45) Date of Patent: Nov. 20, 2001

(54) GUIDEWAY TRANSIT SYSTEM

(76) Inventor: Tae Jin Park, 966-3, line Apt. 103-1407, Moonheung-dong, Buk-ku, Kwangju City, 500-110 (KR)

( * ) Notice: Subject to any disclaimer, the term of this patent is extended or adjusted under 35 U.S.C. 154(b) by 0 days.

(21) Appl. No.: 09/308,979

(22) PCT Filed: Dec. 1, 1997

(86) PCT No.: PCT/KR97/00251

§ 371 Date: May 28, 1999

§ 102(e) Date: May 28, 1999

(87) PCT Pub. No.: WO98/24673

PCT Pub. Date: Jun. 11, 1998

(30) Foreign Application Priority Data

Dec. 2, 1996 (KR) ..... 96-61002

(51) Int. Cl.[7] ..... B61B 13/00

(52) U.S. Cl. ..... 104/88.02; 104/124; 104/125; 180/167

(58) Field of Search ..... 104/124, 125, 104/88.02; 180/167, 168, 169; 404/1

(56) References Cited

U.S. PATENT DOCUMENTS

| | | | | |
|---|---|---|---|---|
| 2,188,293 | * | 1/1940 | Williams | 180/167 |
| 3,118,392 | * | 1/1964 | Zimmerman | 104/88 |
| 3,570,407 | * | 3/1971 | Arthur | 104/242 |
| 3,638,751 | * | 2/1972 | Moll et al. | 180/98 |
| 3,648,228 | * | 3/1972 | Perry | 340/23 |
| 3,668,624 | * | 6/1972 | Spaulding | 340/32 |
| 3,675,584 | * | 7/1972 | Hall | 104/28 |
| 3,790,779 | | 2/1974 | Paddison . | |
| 3,790,780 | * | 2/1974 | Helmcke et al. | 246/187 C |
| 3,898,652 | * | 8/1975 | Rashid | 343/6 R |
| 3,941,201 | * | 3/1976 | Hermann et al. | 180/98 |
| 4,630,961 | * | 12/1986 | Hellwig | 404/1 |
| 4,841,871 | * | 6/1989 | Leibowitz | 104/23.1 |
| 5,846,020 | * | 12/1998 | McKeown | 404/1 |

FOREIGN PATENT DOCUMENTS

| | | | | |
|---|---|---|---|---|
| 14 13 005 B2 | | 4/1972 | (DE) . | |
| 42 41 677 A1 | | 12/1992 | (DE) . | |
| 4118205-A1 | * | 12/1992 | (DE) | B61B/13/00 |

* cited by examiner

*Primary Examiner*—S. Joseph Morano
*Assistant Examiner*—Frantz F. Jules
(74) *Attorney, Agent, or Firm*—McDermott, Will & Emery

(57) ABSTRACT

A PRT (personal rapid transit) system, utilizing both course reservation and branch stop technologies and radically solving the various problems experienced in conventional roadway systems, conventional railway systems and prior art APM or PRT systems, is disclosed. The PRT system of this invention has tunnel-type dedicated guideways located aboveground, groundlevel or underground and is computer-controlled, thus allowing small-sized and standardized PRT vehicles to run along the guideways at high speeds without having any congestion delays. The PRT system thus remarkably increases transit capacity and transit efficiency, provides a comfortable and rapid transit means and radically solves traffic congestion in a large metropolitan region.

3 Claims, 8 Drawing Sheets

GUIDEWAY TRANSIT SYSTEM

BACKGROUND OF THE INVENTION

1. Field of the Invention

The present invention relates, in general, to a PRT (personal rapid transit) system allowing PRT vehicles to run along dedicated guideway networks at high speeds and, more particularly, to a computer-based PRT system utilizing both course reservation and branch stop technologies and having tunnel-type dedicated guideways located aboveground, groundlevel or underground and being computer-controlled, thus allowing small-sized and standardized PRT vehicles to run along the guideways at high speeds without having any congestion delays and thereby radically solving traffic congestion in a large metropolitan region.

2. Description of the Prior Art

As well known to those skilled in the art, traditional public transit systems, such as subways and light electric railways running on fixed schedule, are problematic in that they require long station wait times and are less likely to allow passengers to reach their destinations through shortest courses. Another problem experienced in such public transit systems is that the systems force passengers to make a long distance walk so as to transfer from a train to another train at a transfer station, thus being inconvenient to the passengers, especially to people who transfer. In the above transit systems, each train has to be stopped at every station to debark/embark passengers at the stations, thus being delayed and time-consuming. A further problem of the traditional transit systems resides in that a plurality of trains, with a fixed-passenger carrying capacity, require running along the rails regardless of peak or off-peak hours. Therefore, the trains are unoccupied with passengers during off-peak hours and are highly crowded with passengers during peak hours, thus being run inefficiently. Such transit systems also increase construction costs and require a lengthy period of construction time, causing congestion of urban traffic to become worse.

In an effort to overcome the problems experienced in such traditional public transit systems, several types of automated people mover (APM) systems and personal rapid transit (PRT) systems, such as PRT 2000 and Skycar, have been proposed and feasibly tested in some counties of the world. However, such typical APM or PRT systems are problematic in that they are limited in their passenger carrying capacities in comparison with the traditional public transit systems and cause congestion of urban traffic during rush hour. Such known APM or PRT systems utilize an off-line stop technology and have series platforms, thus reducing transit capacity. The above APM or PRT systems do not allow APM or PRT vehicles to change their lanes on the guideways and so each of the APM or PRT vehicles has to run along a dedicated and fixed lane and this remarkably reduces the transit capacity. In addition, the guideways of the above systems consist of one-way paths, thereby forcing vehicles on the guideways to make detours prior to reaching destinations. A further problem experienced in the above APM or PRT systems is that they fail to provide sufficient vehicle storage areas due to both large-sized vehicles and the structural limit of stations.

SUMMARY OF THE INVENTION

Accordingly, the present invention has been made keeping in mind the above problems occurring in the prior art, and an object of the present invention is to provide a computer-based PRT system, which includes a guideway network consisting of multi-layered guideways located aboveground, groundlevel or underground and is automatically controlled by computers, thus allowing small-sized and standardized PRT vehicles to run along one-way guideways at high speeds without any congestion delays and thereby providing a rapid transit system, having a large passenger carrying capacity and radically solving traffic congestion in a large metropolitan region.

Another object of the present invention is to provide a computer-based PRT guideway network, which consists of multi-layered guideways suitable for allowing small-sized and standardized PRT vehicles to effectively start, stop, be branched from and merge with a main guideway, and change lanes through an integrated computer control process, thus allowing the vehicles to run along the guideways at high speeds without having any congestion delays and increasing transit efficiency, and which utilizes both course reservation and branch stop technologies capable of preventing the PRT vehicles from being delayed due to embarking or debarking, and which effectively reduces the loading, unloading and parking areas at stations while maximizing the platform capacity.

A further object of the present invention is to provide a computer-based PRT vehicle, which is equipped with a plurality of sensors, such as running reference line sensors and control signal unit sensors, and is standardized in its width and height, thus being automatically operated on a dedicated PRT guideway network without any human drivers under the control of computers using various sensor signals.

In order to accomplish the above objects, the present invention provides a PRT system utilizing both course reservation and branch stop technologies and comprising a fully coupled PRT guideway network located aboveground, groundlevel or underground. The network includes main and branch guideways, each of which has a rectangular or arcuate tunnel-shaped cross-section and is arrayed into a two-layered structure with the guideway on each layer being designed to be exclusively used as a one-way path. The branch guideway is branched from the main guideway and extends to a group of terminals. A running reference line is arrayed along the longitudinal center of the ceiling or bottom of each of the main and branch guideways, thus being used as a reference line for PRT vehicles running on the network.

A plurality of control signal units are installed at appropriate positions around the running reference line and are used for outputting control signals for the PRT vehicles running along the guideways. The control signals from the above control signal units indicate reference points of the guideways, designate a desired speed of a vehicle or express the start and end points of a lane changeable area.

Each of the PRT vehicles is standardized in its width and height and includes a running reference line sensor for sensing the running reference line of the PRT network, a control signal unit sensor for sensing a control signal unit of the PRT network, an infrared sensor for sensing any obstacle in front of the vehicle running on the network, a side sensor for sensing side traffic conditions of the vehicle, infrared emitter and receiver for sensing running speeds of vehicles next ahead and behind, and an on-board computer having various programs and data for automatically operating the PRT vehicle on the PRT network.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
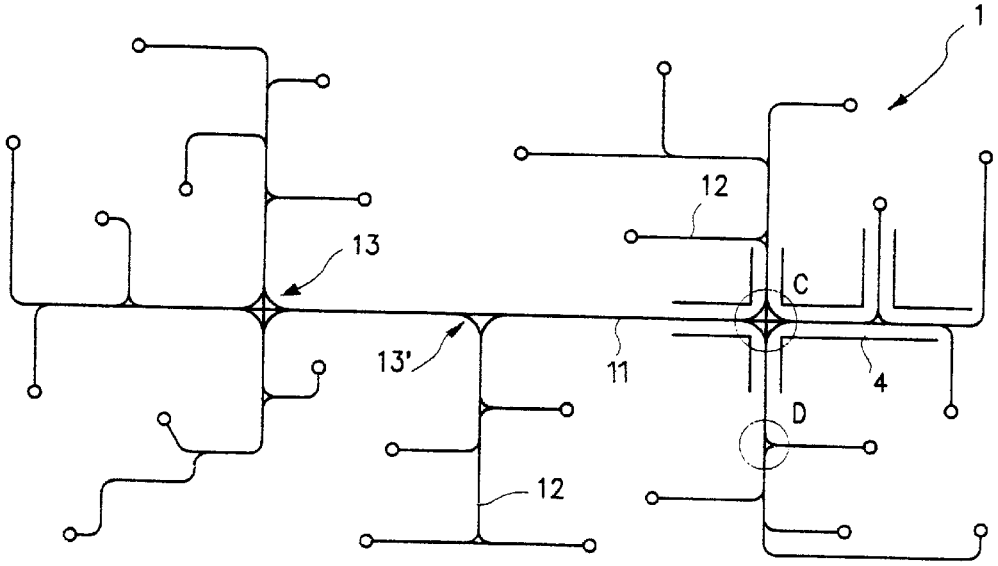
FIG. 1 is a PRT guideway network in accordance with the preferred embodiment of the present invention.

FIG. 1 is a PRT guideway network in accordance with the preferred embodiment of the present invention. As shown in the drawing, the fully coupled PRT network 1 is arrayed into a #-shaped or net-shaped planar network, with a plurality of specifically designed intersecting crossings allowing the PRT vehicles 3 to run at high speeds in every direction at the intersection without being congestion-delayed. Such a PRT network 1 includes a plurality of linear main guideways 11, a plurality of branch guideways 12 and a plurality of terminals 2. Each of the main and branch guideways 11 and 12 has a tunnel-shaped cross-section as will be described later herein. The linear main guideways 11 allow the PRT vehicles 3 to linearly run along at high speeds without being congestion-delayed, while the branch guideways 12 are branched from the main guideways 11 at the crossings and individually extend to a group of terminals 2. The terminals 2, which are located at the terminated points of the branch guideways 12, allow for parking and stopping of the vehicles 3 and embarking and debarking of passengers.

In the above PRT network 1, the main and branch guideways 11 and 12 individually have a rectangular or arcuate tunnel-shaped cross-section with one ceiling, one bottom and two sidewalls. The tunnel guideways 11 and 12 are arrayed into a two or more-layered structure. That is, on low-density traveled routes, one-lane guideway may be arrayed above another guideway with one lane, thus forming a two-layered guideway. However, on heavily traveled routes, two or more one-lane guideways may be arrayed abreast of each other on each layer, thus forming a two-layered guideway with two or more guideways being arrayed on each layer. Alternatively, each of the guideways may be designed into four or more even numbered layers on such heavily traveled routes. In such multi-layered guideways, the guideway on each layer is designed to be exclusively used as a one-way path, thus being completely free from two-way design.

Each of the main and branch guideways 11 and 12, having a rectangular or arcuate tunnel-shaped cross-section with one ceiling, one bottom and two sidewalls, has a vehicle guide function allowing trains of PRT vehicles 3 to travel along a dedicated guideway at high speeds without being delayed or obstructed. The tunnel-type guideways 11 and 12 also completely protect the PRT vehicles 3 from outside weather conditions, such as rain, wind, snow, hail and ice storms.

Figure 2:
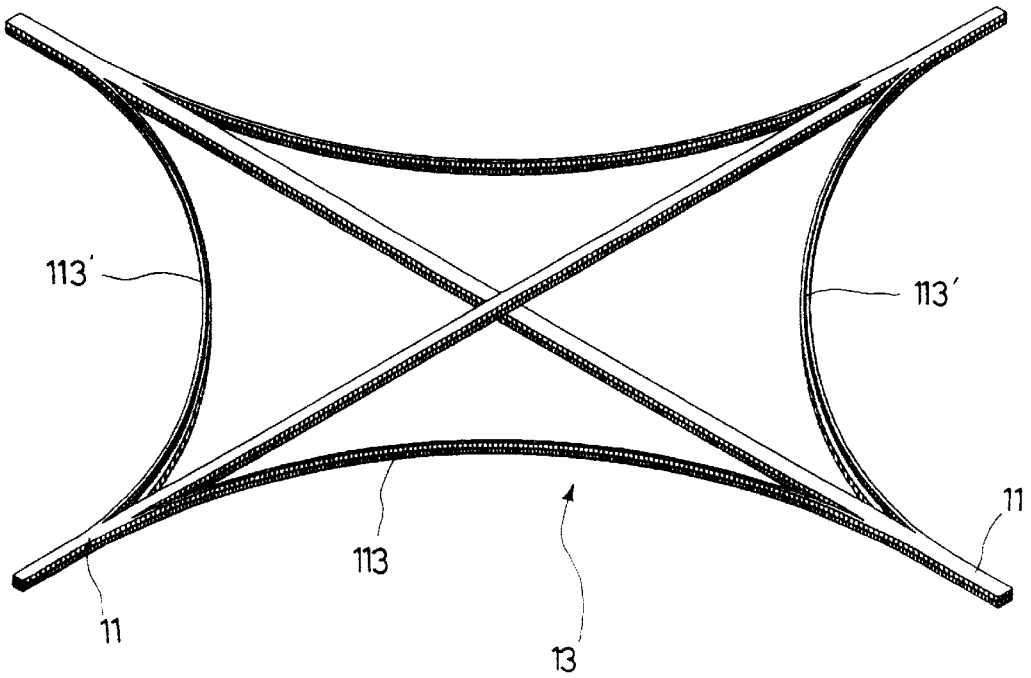
FIG. 2 is a perspective view of the portion "C" of FIG. 1, showing a four-way intersecting crossing of the PRT guideway network of this invention.
Figure 3:
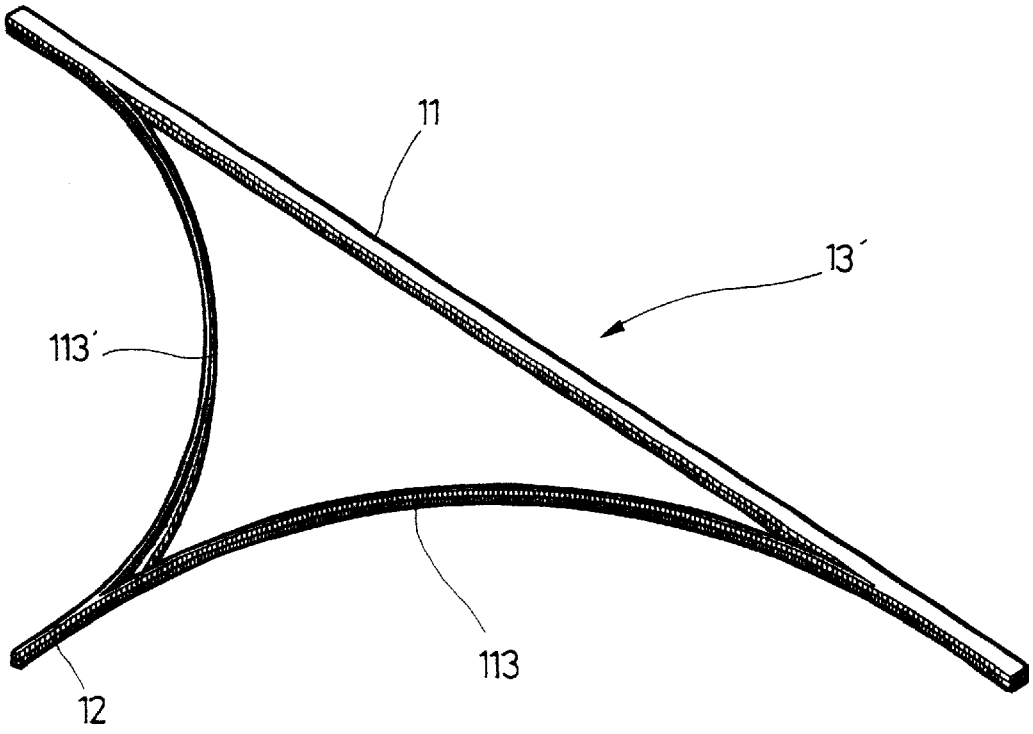
FIG. 3 is a perspective view of the portion "D" of FIG. 1, showing a three-way crossing of the PRT guideway network of this invention.

FIGS. 2 and 3 are perspective views of the portions "C" and "D" of FIG. 1, showing a four-way intersecting crossing and a three-way crossing of the PRT network 1, respectively.

As described above, on low-density traveled routes, the PRT network 1 basically has a two-layered structure with the guideway on each layer being used as a one-way path. However, on heavily traveled routes, two or more one-lane guideways may be arrayed abreast of each other on each layer of a two-layered structure or the guideways may be arrayed into four or more even numbered layers, with the guideway on each layer being used as a one-way path. That is, the layout of the network 1 may be changed in accordance with predicted ridership. The bottom of each guideway is flat, thus being suitable for allowing PRT vehicles 3 to easily change lanes at lane changeable areas. In FIG. 2 showing the network 1 having a two-layered guideway structure as an example, two main guideways 11 intersect with each other at right angles and in three dimensions, thus forming a four-way intersecting crossing 13. Due to the two main guideways 11 individually having a two-layered structure, the intersection of the above crossing 13 has a four-layered structure. Such a four-way intersecting crossing 13 allows a PRT vehicle 3 to turn to the left or right in a desired destination. In such a case, the vehicle 3 continues its running speed without being delayed or stopped. Of course, it is necessary to allow the PRT vehicles 3 to run straight ahead at a crossing 13. That is, the PRT vehicles 3 selectively run straight ahead or turn to the left or right without reducing their running speeds at a crossing 13. In order to accomplish the above object, the four-way intersecting crossing 13 is designed to have four arcuate ramps 113, thus having an almost lozenged layout that is defined by the four arcuate ramps 113 at the edges and crosses at the center as best seen in FIG. 2.

While designing the above four-way intersecting crossing 13, the four ramps 113, individually having a two-layered structure, are designed to connect the two intersecting guideways 11, individually having a two-layered structure, to each other and allow a vehicle 3 on any layer of one of the two intersecting guideways 11 to turn to the left or right prior to reaching any layer of another guideway 11. In order to achieve the above object, the top and bottom layers of each of randomly-selected two opposite ramps 113 are designed to be free from intersecting each other, while the top and bottom layers of each of the other two opposite ramps 113' are designed to intersect each other. In a brief description, two of the four ramps have a non-intersecting layer structure, while the other two ramps have an intersecting layer structure.

Due to the four-way intersecting crossing 13 with such specifically designed four ramps 113, a vehicle 3 on any layer of one of the two intersecting guideways 11 effectively runs straight ahead or smoothly turns to the left or right without being delayed or stopped prior to reaching any layer of another guideway 11. In comparison with ramp facilities of a traditional interchange, the ramps 113 of this invention have a larger radius of curvature, thereby rendering a vehicle a smoother and safer turning motion. Another advantage experienced in the above crossing 13 is that the crossing 13 has a simple design suitable for remarkably reducing the facility area, reducing the construction cost and allowing all the crossings of the network 1 to be designed into intersecting crossings.

Referring next to FIG. 3, a two-layered linear main guideway 11 of the PRT network 1 according to this invention may be coupled to two arcuate ramps 113 and 113' at two points, with the two ramps 113 and 113' being branched from one branch guideway 12 at the left or right side of the main guideway 11, thus forming a three-way planar crossing 13' having an almost triangular layout. In the same manner as that described for the four-way intersecting crossing 13, the top and bottom layers of a randomly-selected one ramp 113 of the above three-way crossing 13' are designed to be free from intersecting each other, while the top and bottom layers of the other ramp 113' are designed to intersect each other. In a brief description, one ramp of the three-way crossing 13' has a non-intersecting layer structure, while the other ramp 113' has an intersecting layer structure.

Due to the three-way crossing 13' with such specifically designed two ramps 113 and 113', a vehicle 3 on any layer of one of the two guideways 11 and 12 effectively runs without being delayed or stopped prior to reaching any layer of the other guideway.

In such a case, the branch guideway 12, branched from the main guideway 11 and extending to a terminal 2, is similar to a main stream entrance or exit path of a conventional roadway system 4. In a long branch guideway 12 without having any ramps 113, it is possible to form the guideway 12 into a two-way layout having a single-layered structure in place of the above-mentioned two-layered structure.

In the PRT guideway network 1 of this invention, the merging area, at which a PRT vehicle 3 from an entrance ramp merges into the main stream of vehicles of a main guideway 11, has to be designed to prevent the PRT vehicle 3 from the ramp 113 from colliding with another vehicle 3 running along the main guideway 11. In order to accomplish the above object, the PRT system of this invention utilizes a course reservation technology capable of reserving an allowed travel space for each and every PRT vehicle passing through merging areas. Such reservations for the merging areas are applied and registered by passengers at start terminals and are managed by a computer so as to allow the vehicles 3 to correctly pass through the merging areas at the reserved times. Therefore, the vehicles 3 smoothly run on the guideway network 1 at high speeds without unexpectedly colliding with each other or having any congestion delays.

In the guideway network 1 of this invention, each of the PRT vehicles 3, which exit into the branch guideway 12 from the main guideway 11, goes to one of several terminals 2 and 2' commonly connected to the branch guideway 12 and berths at one of a plurality of parallel platforms of a selected terminal, thus loading or unloading passengers at the platform. Therefore, the PRT system of this invention allows several tens of vehicles 3 to berth at the platforms of the terminals of one branch guideway 12 at the same time, thus remarkably increasing the platform capacity.

Figure 5:
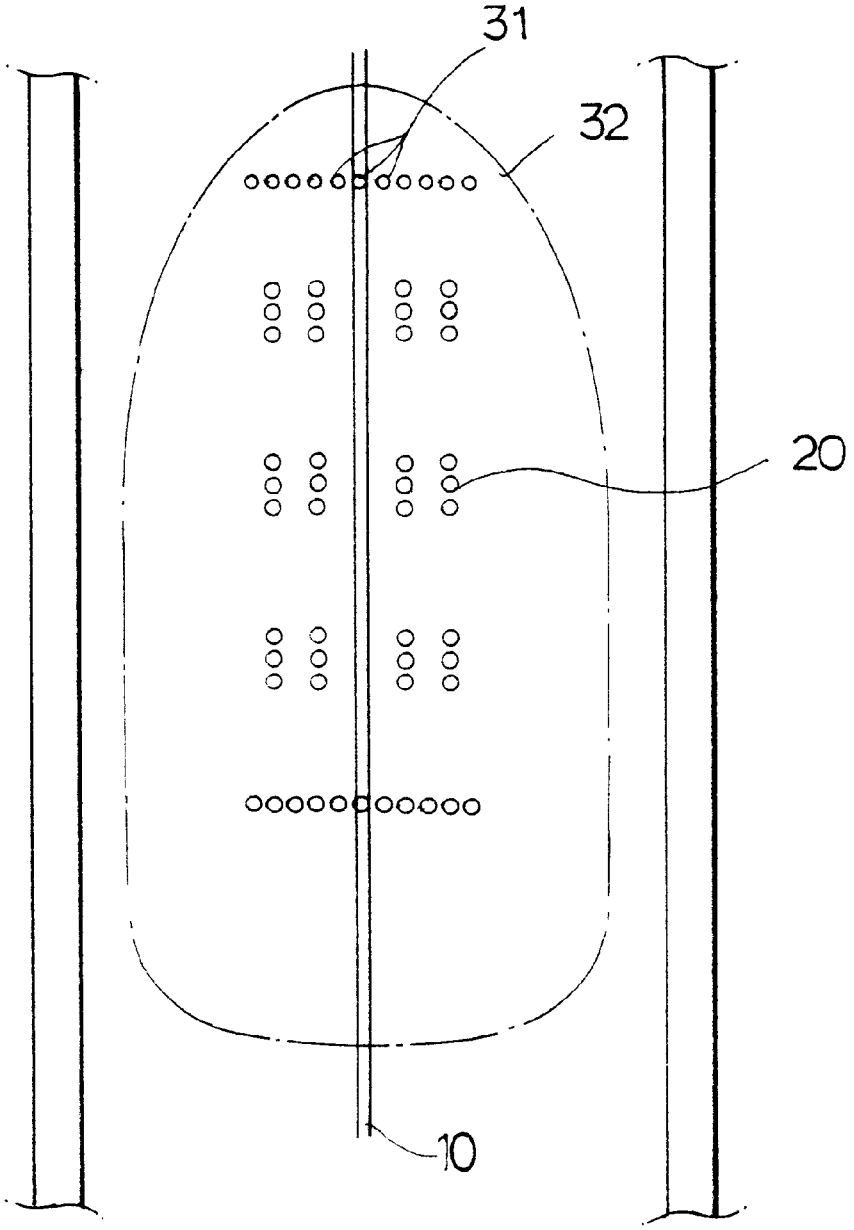
FIG. 5 is a plan view of a dedicated guideway of the PRT guideway network of this invention, showing an arrangement of both control signal units and a running reference line of the guideway.
Figure 6:
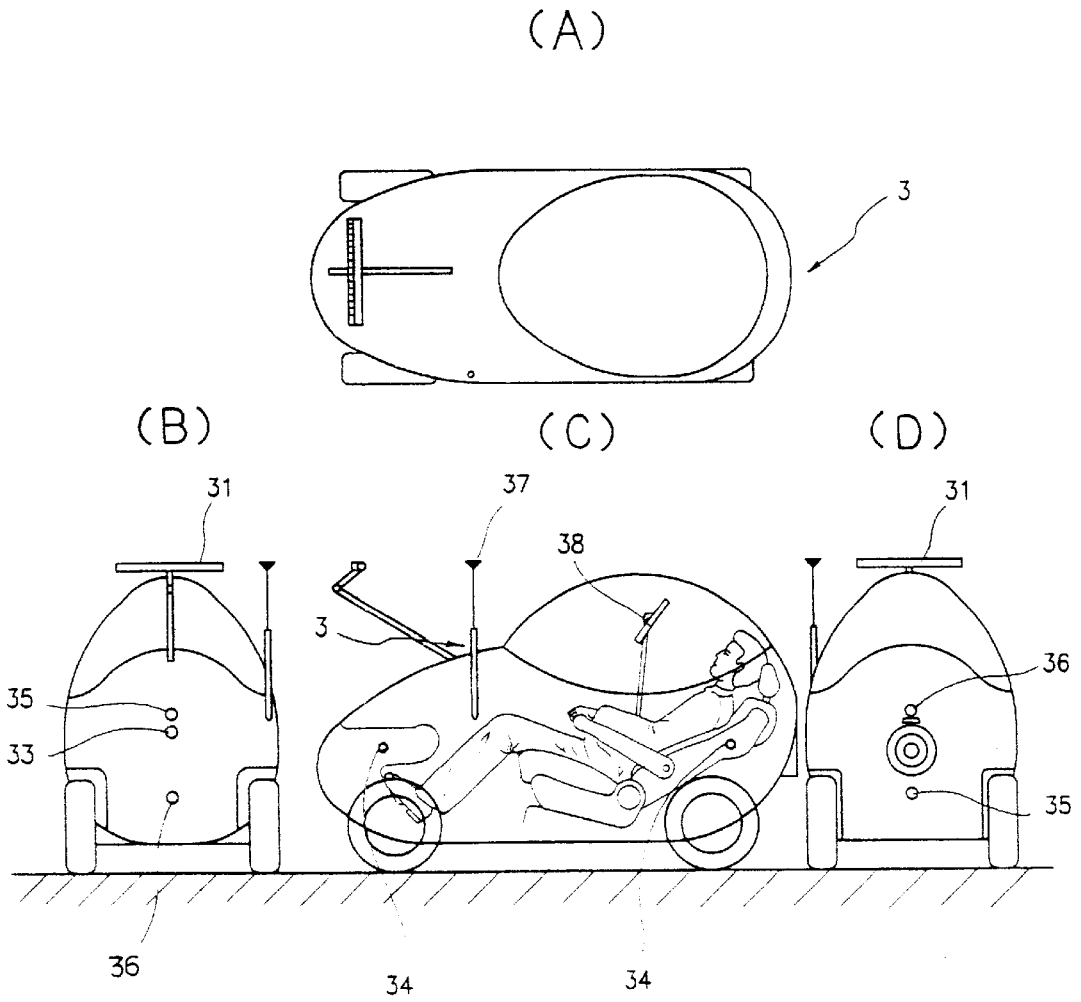
FIGS. 6A to 6D are plan, front, side and rear views of a computer-based PRT vehicle in accordance with the present invention, respectively.

FIG. 5 is a plan view of a guideway of the PRT guideway network 1 of this invention, showing an arrangement of both control signal units and a running reference line of the guideway. As shown in the drawing, the running reference line 10 is provided on the longitudinal center of the ceiling or bottom of each guideway, thus being used as a reference line for vehicles 3 running along the guideway. Meanwhile, the control signal units 20, which perform the same operational functions as those of a road sign of a conventional roadway system 4, are installed at appropriate positions at opposite sides of the reference line 10.

The above running reference line 10, used as a reference line for vehicles 3 running on the guideway network 1, guides and allows PRT vehicles 3 to run along dedicated lanes at high speeds without being unexpectedly diverged from those lanes.

The control signal units 20, which are installed at appropriate positions at opposite sides of the reference line 10, output control signals indicating a reference point that expresses the position of a guideway along which a PRT vehicle 3 runs. The above units 20 also designate an object speed of a vehicle 3 in accordance with guideway conditions and express the running direction of the vehicle 3. Another operation of the units 20 is to inform of the start and end points of a lane changeable area of the network 1 and to control the PRT system using 4000 preset signals.

Figure 4:
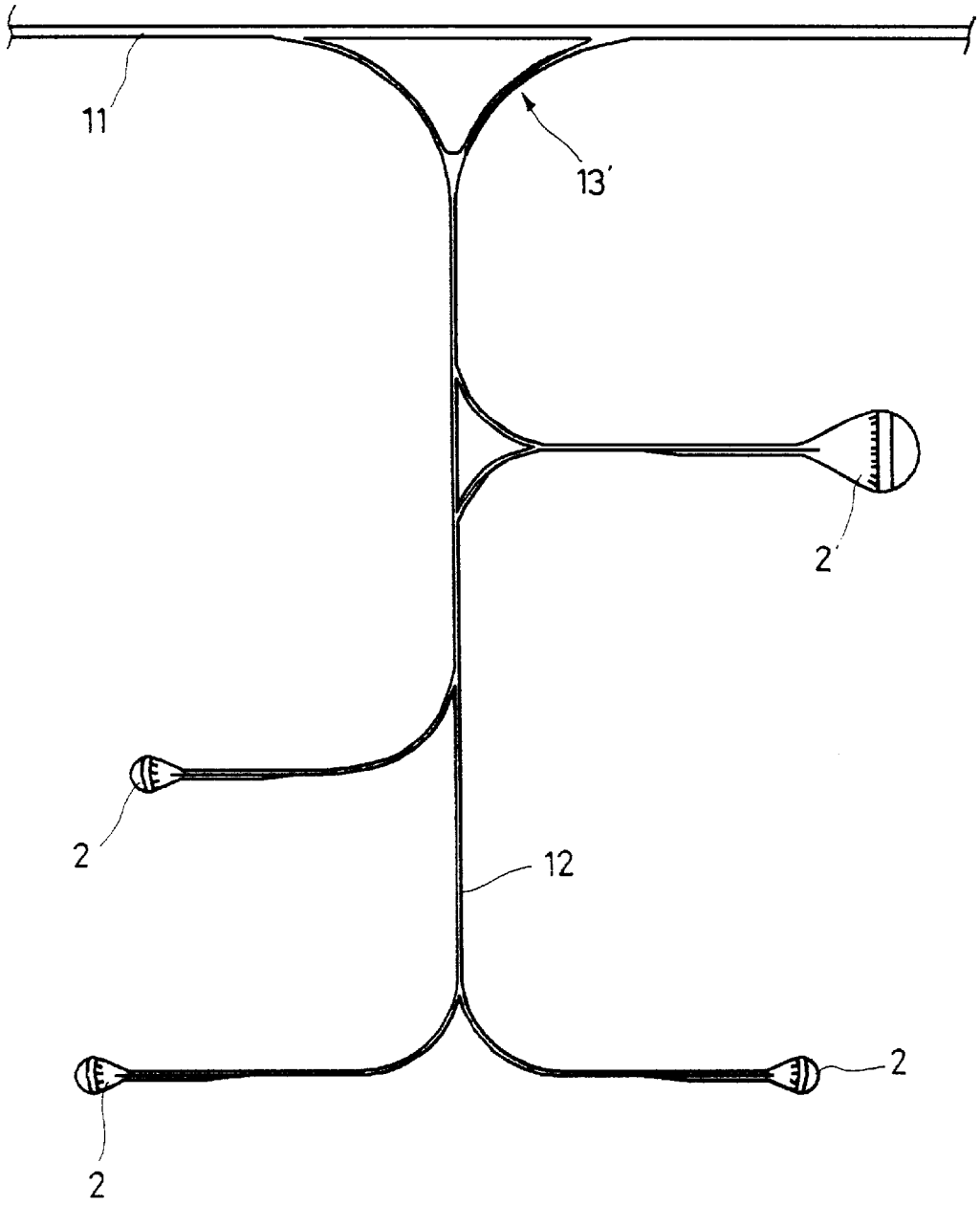
FIG. 4 is a plan view of a branch guideway of the PRT guideway network of this invention, showing an arrangement of main and sub-terminals commonly connected to one branch guideway.

FIG. 4 is a plan view of a branch guideway 12 of the PRT guideway network 1 of this invention, showing an arrangement of main and sub-terminals commonly connected to the branch guideway 12. In the drawing, the branch guideway 12 is coupled to the main guideway 11 through a three-way interchange 13' as an example. As shown in the drawing, the PRT system of this invention utilizes a branch stop technology. That is, the PRT vehicles 3 exit from a main guideway 11 into a branch guideway 12 through a three-way or four-way crossing 13', 13 prior to approaching a destination terminal. In such a case, the ramps 113 and 113' of this invention have a larger radius of curvature in comparison with ramp facilities of a traditional interchange, thus rendering a vehicle 3 a smoother and safer turning motion and allowing the vehicle 3 to continue its running speed while exiting from the main guideway 11 into the branch guideway 12. Therefore, the vehicles 3 on the main guideway 11 are not congestion-delayed due to embarking/debarking of passengers at the terminals. The terminals 2 and 2' are commonly connected to the branch guideway 12 through their terminal ramps along which vehicles 3 gradually reduce their speeds prior to being completely stopped at the platforms of the terminals.

As the PRT system of this invention utilizes the above-mentioned branch stop technology, the vehicles 3 on the main guideway 11 run at high speeds without being congestion-delayed due to embarking/debarking of passengers at the terminals 2 and 2'. Therefore, the PRT system, utilizing both the course reservation and branch stop technologies, radically overcomes congestion delays due to stopping/parking of vehicles and embarking/debarking of passengers at the terminals, thus remarkably increasing transit capability in comparison with conventional transit systems.

Figure 7:
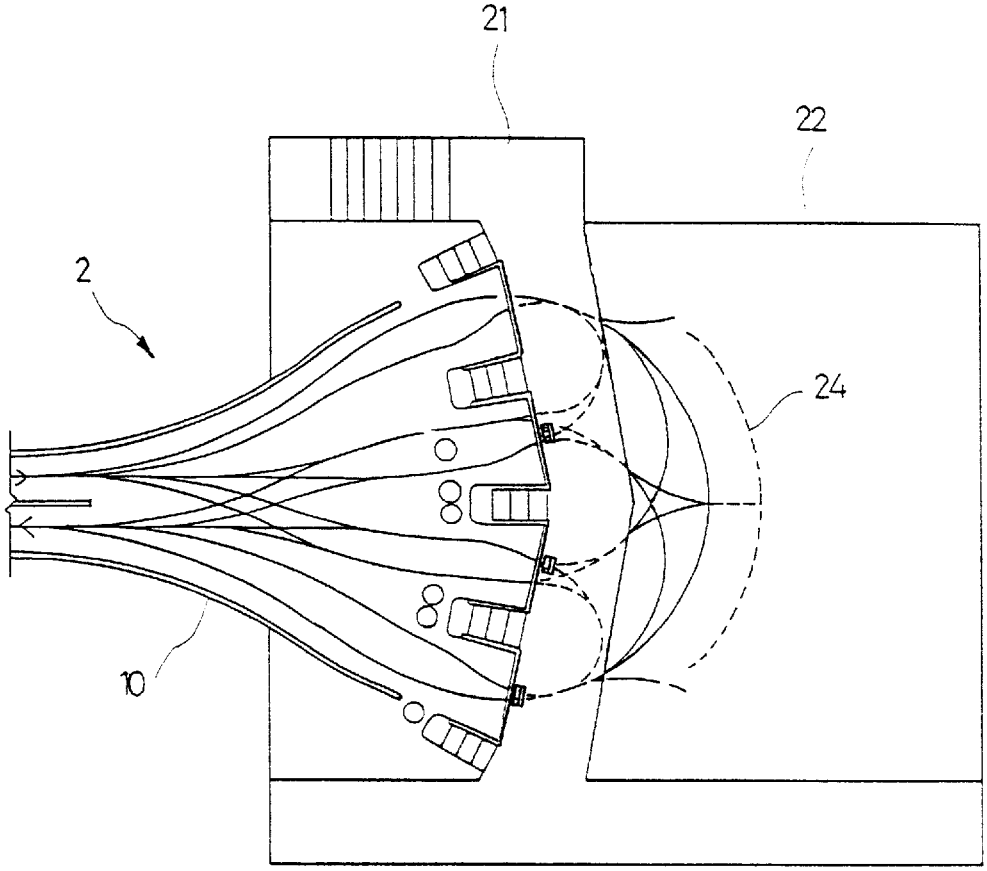
FIG. 7 is a plan view showing the design of a terminal allowing for stopping and starting of vehicles and embarking and debarking of passengers in the PRT guideway network of the present invention.
Figure 8:
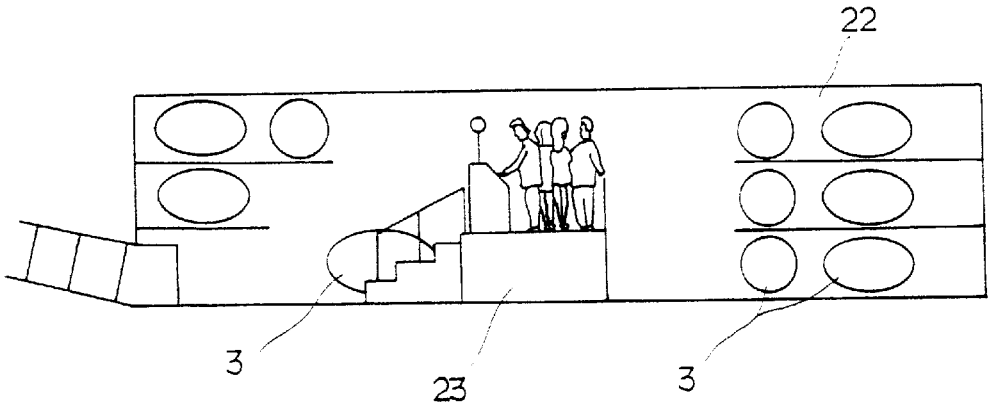
FIG. 8 is a side view showing the design of a terminal with passenger passages, vehicle berths and multi-layered parking areas according to the present invention.

FIG. 7 is a plan view showing the design of a terminal 2 allowing for stopping and starting of vehicles 3 and embarking and debarking of passengers in the PRT guideway network 1 of this invention. FIG. 8 is a side view showing the design of a terminal 2 with passenger passages 21, vehicle berths and multi-layered parking areas 22 according to the invention. The terminals of the PRT system of this invention are designed as follows.

In the PRT system of this invention, the terminals 2 are primarily used as PRT vehicle berthing areas for stopping/ parking of PRT vehicles and embarking/debarking of passengers. The terminals 2 are secondarily used as PRT vehicle bases for checking, washing, battery changing, repairing and parking of PRT vehicles 3. As shown in FIG. 7, each of the terminal ramps, which is branched from a branch guideway 12 and is terminated at its associated terminal 2, converts its layer structure from a two-layered structure into a single-layered structure at a position around the entrance of a terminal 2. In the terminal ramp having such a single-layered structure, a plurality of one-way paths are arrayed abreast of each other and extend broadwise like the ribs of a hand fan. Therefore, the platforms 23 of the terminal 2 are arrayed abreast like toll collection gates of a conventional roadway system. That is, the berthing area of each terminal 2 of this invention consists of a plurality of parallel platforms 23. The one-way paths from debarking platforms 23 are coupled to their U-turn paths 24, thus guiding the vehicles 3 to embarking platforms 23 or to a parking area 22 for checking, washing, battery changing, repairing and parking of the PRT vehicles 3. Due to such parallel platforms 23, the terminals 2 of this invention remarkably increase the platform capacity.

In each terminal 2, the embarking and debarking platforms 23 are coupled to a passenger passage 21 through stairways. In the present invention, it is preferable to commonly connect two platforms 23 to the passenger passage 21 through one stairway, thus reducing the area of the terminal 2. Due to such an arrangement of the platforms 23, the PRT vehicles 3 preferably enter the debarking platforms 23 in the registered priority order of vehicle numbers 1-3-2-4. The vehicles 3 may preferably start from the embarking platforms 23 in the same order as the entrance order. Of course, the priority order of vehicle numbers 3, starting from the embarking platforms 23, may be changed from the above order of 1-3-2-4.

When PRT vehicles 3 unexpectedly fail to reach the debarking platforms 23 at the scheduled times, the entrance order of the vehicles 3 may be reappointed by control signal units 20 which are installed at the entrance of the platforms 23. The above units 20 are designed to be stably operated even in the event of an electricity failure, thus almost completely preventing congestion delays at the terminals 2.

In the terminals 2, the platforms 23 are preferably designed into a switchable type suitable for being changeable between embarking and debarking platforms in accordance with the ratio of loading and unloading capacities. That is, each platform 23 may be used as an embarking platform when it is necessary to provide a loading capacity larger than a previous unloading capacity or as a debarking platform when it is necessary to provide an unloading capacity larger than a previous loading capacity. In order to design the platforms 23 into such a switchable type, the entrance and exit paths for the platforms 23 are coupled to each other through their running reference lines 10, thus freely switching the platforms 23 between the two types of platforms in accordance with the ratio of loading capacity to unloading capacity. The PRT system of this invention thus remarkably increases platform capacities of the terminals 2. In addition, it is possible to designate the vehicle numbers of trains of vehicles 3 so as to allow the trains of vehicles 3 to sequentially start from an embarking platform with time intervals and run along one guideway prior to sequentially stopping at a debarking platform with time intervals, thus remarkably increasing platform capacity.

As shown in FIG. 4, ten or less terminals, which are commonly coupled to one branch guideway 12, include one main terminal 2'. Such a main terminal 2' has a large-capacity parking area and is coupled to the branch guideway 12 through a three-way crossing 13', thus allowing any empty PRT vehicle 3 to rapidly run between the main terminal 2' and any one of the sub-terminals 2. A main computer is installed in one of the terminals 2 and 2' and is used for controlling the start of vehicles at the terminal, checking empty vehicles, requesting a system computer for empty vehicles, monitoring and controlling the vehicles running on the guideways within its jurisdiction, receiving a reservation for using the merging areas under its jurisdiction, managing the merging areas according to the reserved schedule, judging the existing state of the network 1 in the event of emergencies or abnormal running conditions, and appropriately dealing with the abnormal network 1 by judging results during such emergencies or abnormal running conditions.

The vehicles 3 suitable for running on the PRT guideway network 1 of this invention are specifically designed as will be described hereinbelow.

FIGS. 6A to 6D are plan, front, side and rear views of a computer-based PRT vehicle 3 in accordance with the present invention, respectively. As shown in the drawings, the PRT vehicle 3 is specifically designed to effectively and exclusively run on the dedicated PRT guideway network 1 of this invention at high speeds. In order to allow a PRT vehicle 3 to exclusively run on the dedicated network 1 under the control of computers, each of the PRT vehicles 3 is standardized in its width and height. However, the length of the vehicles 3 may be changed in accordance with the type of vehicles classified into freight, individual and public passenger vehicles. The PRT vehicle 3 is also equipped with a plurality of sensors, such as RRL (running reference line) sensors 31 installed at the top or bottom of the vehicle 3 and used for sensing the running reference lines 10 of the network 1 and CSU (control signal unit) sensors 32 used for sensing the control signal units 20 of the network 1. Each of the front and rear ends of the vehicle 3 is provided with both an infrared emitter 35 and an infrared receiver 36. The front and rear infrared emitters 35 of one of trains of vehicles 3 running along a lane emit infrared signals to the infrared receivers 36 of vehicles 3 next ahead and behind, while the front and rear infrared receivers 36 of the vehicle 3 receive infrared signals from the infrared emitters 35 of the vehicles 3 next ahead and behind, thus controlling both the intervals between the three vehicles 3 and a change of running speed. The vehicle 3 also has a plurality of side sensors 34 for sensing side traffic conditions of the vehicle 3. An infrared sensor 33 is provided at the front of the vehicle 3 so as to recognize any obstacle ahead of a traveling vehicle other than the vehicle 3 next ahead. The vehicle 3 also has a radio antenna 37, a modem and an on-board computer. The on-board computer operates both input signals from the sensors 33, 34, 35 and 36 and radio signals from the radio antenna 37 through a programmed process with stored data, thus outputting pulse signals indicating target speed and steering angle of the vehicle 3.

That is, the on-board computer of the above vehicle 3 receives radio-signals from beacons of the network 1 at regular time intervals, thus performing an automated navigation process using input signals from the sensors and radio antenna, programmed data and reserved running course. Therefore, the on-board computer automatically controls the running speed and steering angle of the vehicle 3 and allows the vehicle 3 to automatically move on the network 1 at high speeds and safely reach a reserved destination without any human drivers.

The PRT vehicles 3 of this invention are automatically operated on the network 1 under the control of the on-board computers as follows. That is, the LCD screen 38 of the on-board computer of a PRT vehicle 3 continuously displays present time, reserved arrival time, remaining time before arrival and present position of the vehicle 3 in the network 1. While moving on the network 1, a passenger in a vehicle 3 may request permission to change his destination by operating a top-down menu using an arrow key. In addition, the passenger, who is not responsible for driving the vehicle 3, may freely play a game program, watch TV news, stock exchange quotations or moving picture, talk over the phone, listen to music, request permission to use a lay-by or study the geography of a place using the on-board computer.

In the present invention, a changeable battery may be preferably used as a power source for both the propulsion unit and on-board computer of the vehicle 3.

In the above PRT vehicle 3, additional sensors are preferably provided at positions between the RRL sensors 31 and the CSU sensors 32 so as to sense the signals from the control signal units 20 even when the RRL sensors 31 of the vehicle 3 are diverged from the running reference line 10.

In one train of vehicles 3, the front and rear infrared emitters 35 emit infrared signals to the infrared receivers 36 of vehicles 3 next ahead and behind, while the front and rear infrared receivers 36 receive infrared signals from the infrared emitters 35 of the vehicles 3 next ahead and behind, thus appropriately controlling the intervals between the three vehicles 3 and changing the speed so as to almost completely prevent the trains of vehicles 3 on one lane from colliding with each other. When the CSU sensors 32 of a vehicle 3, running on the network 1, receive signals from the control signal units 20, the front and rear infrared emitters 35 of the vehicle 3 output infrared signals to the front and rear areas of the vehicle 3, respectively. When the front and rear infrared receivers 36 of the vehicle 3 receive infrared signals from other vehicles 3 next ahead and behind, the on-board computer calculates a time difference between arrival of vehicles 3 at the control signal units 20 and running speeds, thus calculating the interval between the three vehicles 3.

When the rear infrared receiver 36 of a vehicle 3 receives an infrared signal from the vehicle 3 next behind, the on-board computer outputs a signal, indicating the running speed and normal or abnormal running conditions, to the rear vehicle 3. In such a case, when the vehicle 3 runs along the guideway at a changed speed, the output signal indicates the changed speed through a predetermined method. However, when the vehicle 3 runs along the guideway at a normal speed, the on-board computer outputs pulse signals with regular time intervals as the vehicle 3 passes by the control signal units 20. When the infrared receiver 36 does not receive any signals from the rear, the on-board computer does not output any signals to the rear except for emergencies such as a sudden braking operation. In order to prevent the vehicles 3 from unexpectedly colliding with each other during such emergencies, the braking distances for the vehicles 3 have to be shortened by forming the bottom of the vehicles 3 using rubber or urethan materials.

The vehicle 3 also has two front and two rear side sensors 34 at each side, thus having eight side sensors 34 at both sides. The side sensors 34 are for sensing any side vehicles running along side lanes, thus preventing the vehicle from unexpectedly colliding with another vehicle while changing lanes. The above side sensors 34 also perform a checking operation while a vehicle 3 runs along an entrance ramp for a merging area. During such a checking operation, two of four side sensors 34, individually having a shorter sensing distance, check whether another vehicle 3 runs along the guideway for the target merging area. While the vehicle 3 runs along an entrance ramp for the target merging area, the sensors 34, 35 and 36 check any obstacle in front and rear areas of the vehicle 3 and sense the main stream of vehicles 3 on the main guideway 11. In such a case, the vehicle 3 may be appropriately accelerated or decelerated under the control of the on-board computer, thus being completely prevented from colliding with another vehicle 3 at the merging area.

In order to allow the PRT vehicles 3 to safely merge into the main stream of vehicles on a main guideway 11, two or more vehicle sensors are preferably provided at the ceiling and bottom or both sidewalls of the guideway at a position around each running direction setting point of the network 1. Therefore, it is possible to sense both the running speeds of vehicles 3 and a difference in the times the vehicles 3 pass by the vehicle sensors. When it is checked that a vehicle 3, running along the entrance ramp, may collide with another vehicle 3, running along the main guideway 11, at a merging area, the vehicle sensors control the running speed of the vehicle 3 on the entrance ramp, thus preventing the vehicles 3 from colliding with each other at the merging area. In the present invention, it is preferable to operate the above vehicle sensors using a UPS (unfailure power source).

When a PRT vehicle 3 berths at a debarking platform 23 of a terminal 2, the side door of the vehicle 3 is automatically opened to allow passengers to be debarked at the platform 23. Thereafter, the on-board computer of the vehicle 3 communicates with a sub-computer of the terminal through a preset process, thus giving data of the vehicle 3 to the sub-computer and allowing the sub-computer to check the operational conditions of the vehicle 3. When the sub-computer determines that the vehicle 3 requires repairing, the vehicle 3 automatically moves to a parking area 22 of the terminal 2 under the control of the sub-computer. At the parking area 22, the vehicle 3 is subjected to maintenance, such as checking of vehicle conditions, washing, battery changing or element changing. Meanwhile, when the sub-computer determines that the vehicle 3 does not require any repairing, the vehicle 3 runs along a U-turn path 24 of the terminal 2 under the control of the sub-computer prior to berthing at an embarking platform 23. At the embarking platform 23, the on-board computer of the vehicle 3 receives data for a designated running course and checks the completion of embarking and closes the side door of the vehicle 3 prior to starting the vehicle 3 for a reserved destination.

While berthing at a debarking platform 23 of a terminal 2, the on-board computer of a vehicle 3 also gives data to the sub-computer of the terminal 2, the data indicating a start terminal number, start time interval, vehicle number, running history of the vehicle, guideway conditions, element conditions, vehicle maintenance period, present voltage of power source battery, discrimination between empty vehicles, freight vehicles and passenger vehicles, and any operational error generated while running on the network 1.

In addition, a radio-beacon monitor station is installed at the main terminal 2, while both a mobile station and a telephone exchange station are installed in the vehicle 3. Therefore, passenger(s) in the vehicles 3 can use TDMA or CDMA-type telecommunication. Such stations also control the vehicles 3 to change their running course while the vehicles 3 run on the network 1. Due to such stations, passenger(s) in a vehicle 3 running on the network 1 can give an account of emergencies or abnormal running conditions to the radio-beacon monitor station and such emergencies or abnormal running conditions can be appropriately dealt with. The PRT guideway network 1 of this invention is equipped with an air conditioning system, while the vehicle 3 is preferably equipped with a HVAC (heating, ventilating and air conditioning) system. Therefore, it is possible to feed appropriate temperature fresh air into the passenger compartments of the vehicles 3 running on the network 1, thus allowing the passengers to feel comfortable.

In the present invention, the propulsion power source for each PRT vehicle 3 may be preferably achieved by an on-board battery as described above. However, it should be understood that the propulsion power source may be achieved by an electric power feeding technology in the same manner as a conventional electric railway system. As a further alternative, the propulsion power source for the PRT vehicle 3 may be achieved by an internal combustion engine.

The operational effect of the PRT system utilizing the course reservation and branch stop technologies will be described hereinbelow.

A passenger, who wants to use the PRT system of this invention, selects both his destination and desired embarking/debarking times at a ticketing machine and receives a ticket from the ticketing machine. Thereafter, the passenger inserts the ticket into a ticket collection gate, thus being allowed to board a designated PRT vehicle 3 berthing at an embarking platform 23. During off-peak hours requiring a negligible platform wait time, the ticketing machine may directly designate an embarking platform number for the passenger in place of issuing a ticket. In such a case, the passenger is also allowed to board a PRT vehicle at a designated embarking platform.

After embarking the passenger as described above, the vehicle 3 is controlled by the sub-computer of the terminal 2. That is, the sub-computer communicates with the ticketing machine so as to select the shortest course for the passenger's destination and reserve a vehicle start time. Thereafter, the sub-computer communicates with the main computer of the group of terminals, thus giving data to the main computer. Upon receiving the data from the sub-computer, the main computer secures the reserved course in the network 1 so as to allow the vehicle 3 to be completely free from colliding with another vehicle while running along the course. The main computer confirms and registers the start time, reserved course and method of passing through the sectioned areas of the course prior to sending data to the sub-computer. Upon receiving the data from the main computer, the sub-computer communicates with the on-board computer of the vehicle 3 through an optical, radio or cable communication. After the communication, the sub-computer confirms the communicated data again.

When the passenger embarking and the data communication between the main, sub and on-board computers are completely accomplished, preparation for vehicle starting is finished. After finishing preparation for vehicle starting, a front sensor covering panel is removed from the platform at the reserved start time, while the on-board computer receives an accelerating signal or a start signal from the sub-computer, thus starting the vehicle 3 for the reserved destination. In such a case, the on-board computer may be operated by a battery. The vehicle 3 from the embarking platform 23 of a terminal 2 runs along a branch guideway 12 prior to merging into the main stream of vehicles on a main guideway 11 for the destination.

As known to those skilled in the art, AGT (automatic guideway transit) vehicles are operated without any human drivers, thus utilizing a longitudinal lane running technology. The PRT vehicle 3 of this invention also utilizes such a longitudinal lane running technology and runs on the guideway network 1 at high speeds under the control of computers as will be described hereinbelow.

That is, the PRT vehicle 3 runs along the main and branch guideways 11 and 12 while sensing the running reference line 10 of the network 1 using the RRL sensors 31. While running along the guideways, the RRL sensors 31 may be somewhat diverged from the reference line 10 due to acceleration force and/or inertia force acting on the vehicle 3. However, such a divergence from the reference line 10 may be corrected by a motor controller, which controls the steering angle of the vehicle 3 and allows the vehicle 3 to run along the reference line 10 without failure. In the network 1, each sectioned area of a guideway is divided into a plurality of sub-sections in lane change areas, such as branching areas, merging areas and other lane changing areas. The above sub-sections are designated by different reference numbers and individually have one merging area. Each of the sub-sections comprises of a plurality of intervals, each of which refers to the length of time one train of vehicles 3, running along a main guideway at normal speeds and normal intervals, spends until it reaches a position of a vehicle next ahead. At the merging area of each sub-section of the PRT network 1, there may be no vehicle, one vehicle running from a left entrance ramp or one vehicle from a right entrance ramp at every interval, thus allowing the PRT vehicles 3 to use the merging area in accordance with reserved priority at every interval.

The main computer, which is installed at a facility of 10 or less terminals 2 commonly connected to the same branch guideway 12 and is used for controlling the terminals 2, is coupled to both the system computer and the other main computers. The above main computers set a clock by the synchronous time signal(s), which is periodically output from the system computer one or more times a day. The main computers thus synchronize with each other and control the vehicle start time and individually have jurisdiction over a sectioned area of the network 1, which consists of a plurality of sub-sections.

Each of the above main computers controls all the sub-sections under its jurisdiction using a section array structure at every interval and performs inquiry, reservation, registration and cancellation.

In the event of a small system capacity, it is possible to equip the network 1 with one system computer, which is a large capacity super computer or a parallel-type vector processor, thus allowing the system computer to keep, manage and use the information about the section array structure. However, in the event of a large system capacity, a computer has to be installed at each of the terminals so as to properly control the vehicles. In such a case, the computers of the terminals have to be coupled to each other through a communication network.

The main computers are coupled to each other through a communication network and are also coupled to associated sub-computers. Each of the main computers selects several start intervals, at each of which a vehicle 3 is scheduled to pass through a branch guideway 12 or merge into the main stream of vehicles on a main guideway 11. After selecting the several start intervals, the main computer sends data of the selected start intervals to another main computer having jurisdiction over the next sectioned area, thus requesting permission to pass through the next sectioned area without being obstructed. Due to such a communication between the main computers, the main computer of the start terminal 2 finally determines one of the selected start intervals at which the vehicle 3 can start and run through the sectioned areas from the start terminal to the last sectioned area under the jurisdiction of the main computer of the destination terminal 2. The finally selected start interval is registered and reserved in the main computers which have jurisdiction over the sectioned areas from the start to the last terminals. Therefore, the vehicle 3 leaves the start terminal at the finally selected start interval and safely passes through the merging areas at the reserved times.

During such an inquiry of possible start intervals, the data signals may be erased by a main computer before the vehicle 3 reaches its destination. In such a case, the main computer, erasing the data signals, sends erasion particulars to the main computer of the start terminal through the system computer. Upon receiving the erasion particulars, the main computer of the start terminal either changes the course to a second or third shortest course in accordance with the erasion particulars or changes the start intervals to other intervals prior to performing an inquiry of the intervals.

At every sectioned area, the area passing course at every branching point is expressed by data indicating priority of vehicles to pass through the branching point.

When the main computer of the start terminal registers the area passing course and finally determines the starting time, the main computer sends data to the sub-computer of a terminal at which the vehicle 3 berths. Upon receiving the data from the main computer, the sub-computer sends the data to the on-board computer of the vehicle 3, thus allowing the vehicle 3 to appropriately start at a reserved start time and safely run along the reserved course. When the vehicle 3 runs along the reserved course of the network 1, the on-board computer compares the practical passing interval with a reserved interval at every reference point so as to correct the passing interval, thus allowing the vehicle 3 to safely pass through the merging areas at the reserved times.

The data, stored in each element of the section array structure, is shifted at every interval. Therefore, when the vehicle 3 reaches the first point of a sectioned area, the data is shifted from the prior element into the next element and is erased when the vehicle 3 completely passes through the sectioned area. The main computer checks the running conditions of the vehicles 3 running along the guideways 11 within the sectioned area under its jurisdiction. The main computer may control the running speeds of the vehicles 3 in the event of emergencies or abnormal running conditions. When the main computer fails to appropriately control the vehicles 3 in the event of such emergencies or abnormal running conditions, the main computer gives an account of emergencies or abnormal running conditions to the system computer, thus allowing the system computer to appropriately deal with such emergencies or abnormal running conditions. When such emergencies or abnormal running conditions are not completely resolved, the main and system computers send information to other main computers around the area of the emergencies or abnormal running conditions.

When the inquiry success ratio is lower than a reference ratio or the vehicle berthing capacity of a terminal is expected to be full, the main computer completely checks the branch guideway 12 so as to inquire into the array structures of both the debarking areas and the main guideway under its jurisdiction. When the element registration ratio is not lower than a reference ratio, the main computer outputs an alarm signal indicative of a busy area to the system computer, thus preventing any expected congestion delays.

Upon receiving such alarm signals from main computers, the system computer monitors the terminals, which refuse the entrance of passengers due to a traffic accident, busy area or construction area. After the monitoring, the system computer sends alarm signals to the main computers associated with the busy terminals. The main computers output alarm signals to the terminals, thus allowing passengers to be informed of such busy conditions prior to using the PRT system. In the event of an unavoidable case such as a complete sellout of available passenger space, the main computer guides passengers to use roundabout courses, wait at the terminal or use other terminals. Of course, the main computer also may reimburse passengers for issued but unused tickets.

In the event of a long course with the element registration ratio being not higher than 20–30%, the element using ratio of the course is somewhat low and so the array structure for such a long course consists of a memory, having an index value, in place of elements. The index value is reduced at every interval so as to register an index value in the array structure when the lowest element of the array structure is equal to the reduced index value. In addition, the washing, checking, maintaining, repairing or rescuing work, which is performed on the guideway network 1 one or more times a day, is registered in the array structure prior to being practically performed.

In the network 1, the vehicle 3 runs along a designated guideway in accordance with a preset course reserved at the start terminal. The guideways of the network 1 individually have a flat bottom regardless of main or branch guideways, thus allowing the vehicles 3 to easily change lanes at lane changing areas where the guideway is free from sidewalls. In the PRT network 1 of this invention, the vehicles 3 can change lanes or courses under the control of the main computers while running along the guideways.

In order to change lanes at a lane changeable area, the on-board computer of a vehicle 3 operates a servo-motor or a step-motor through a programmed process, thus changing lanes as desired.

In order to continuously change several lanes, it is necessary to allow an opening in the target lanes for the vehicle to move into at the lane change time. In the event of an unavoidable case, the vehicle 3 may be accelerated or decelerated by a half interval so as to continuously change the several lanes. In such a case, it is necessary to decelerate or accelerate the vehicle 3 on the final target lane by a half interval, thus allowing the vehicle 3 to set the interval again. Since all the vehicles 3, running on the network 1, synchronize with each other, the vehicles 3 on several lanes are positioned abreast of each other while they run along their lanes and trains of vehicles 3 on one lane are spaced apart from each other at regular intervals. In order to allow the vehicles 3 to run on the network 1 in the manner as described above, it is necessary to control the start timing and recognize and correct the speed control signals output from the control signal units which are installed at points corresponding to the integral numbered times of the interval.

The running speed of a PRT vehicle 3 is controlled by a motor controller which is operated by a computer. In addition, it is necessary to increase the number of lanes so as to prevent congestion delays at expected bottleneck areas, such as branching areas, slope areas or turning areas where the vehicles 3 have to reduce their speeds and are individually prevented from smoothly passing through within a preset interval.

The main computer, having jurisdiction over each sectioned area, checks any traffic accidents in response to radio signals output from both the on-board computers and sensors. In the event of a traffic accident, the main computer tries to appropriately deal with the accident. However, when the main computer fails to appropriately deal with the accident, the main computer communicates with the system computer prior to dispatching a restoration team to the area of the accident. Thus, it is possible to shortly restore normal conditions.

In the guideways 11 and 12 of the PRT network 1 of this invention, the number of lanes of each guideway may be freely designed in accordance with a predicted density of travel. In addition, the PRT vehicles 3 of this invention may be separately designed to be suitable for moving passengers or goods exclusively. The PRT vehicles 3 for passengers also may be separately designed into 1-passenger vehicles or public passenger vehicles.

As described above, the present invention provides a computer-based PRT system, which utilizes both course reservation and branch stop technologies and radically solves the various problems experienced in the conventional roadway systems, conventional railway systems and prior art APM or PRT systems. The PRT system of this invention has tunnel-type dedicated guideways located aboveground, groundlevel or underground and is computer-controlled, thus allowing small-sized PRT vehicles to run along the guideways at high speeds without having any congestion delays. The PRT system of this invention thus remarkably increases transit capacity and transit efficiency, provides a comfortable and rapid transit means and radically solves traffic congestion in a large metropolitan region.

In accordance with the PRT system of this invention, the small-sized and standardized PRT vehicles allow the guideway network to be easily constructed within a relatively short time in comparison with conventional transit systems, thus reducing construction costs. Since the above PRT system allows the vehicles to run at high speeds without being congestion-delayed, they are, thus, almost completely free from excessive time or fuel consumption due to congestion delays.

Due to the small-size and standardization of the PRT vehicles, the dedicated guideways do not require any large facility area. The guideways of this invention are designed as a tunnel type, thus completely protecting the PRT vehicles from outside weather conditions, such as rain, wind, snow, hail and ice storms. The PRT network of this invention is also preferably used for moving goods at high speeds, thus reducing transportation costs of goods. The above PRT system is also free from any problems of energy consumption or environmental pollution caused by exhaust gases different from conventional transit systems. Particularly, in comparison with a conventional subway system or a known PRT system utilizing an off-line stop technology, the PRT system utilizing both course reservation and branch stop technologies according to the invention remarkably improves the transit capacity and transit efficiency as will be represented in the following table.

In the PRT network of this invention, each branch guideway has approximately 80 parallel platforms which allow 20,000 or more persons to be debarked per 1 hour. Therefore, it is possible to transit 1,440,000 persons per 1 hour when a guideway for a highly traveled route is designed to have 40 lanes. The following table shows advantages of the PRT system of this invention in detail in comparison with a conventional subway and a known PRT system (PRT 2000) utilizing an off-line stop technology.

TABLE

| compare item | pre-condition | subway | PRT (PRT2000) | branch stop PRT |
|---|---|---|---|---|
| platform capacity | 1 station 1 branch | 2,000 psn/Hr | 720 psn/Hr | 24,000 psn/Hr |
| headway | normal operation | 120 sec | 2.5 sec | 0.1 sec |
| moving velocity | liner line | 40 km/Hr | 40 km/Hr | 120 km/Hr |
| line capacity | at rush hour | 40,000 psn/Hr 2,000 psn × 20 times | 1,440 psn/Hr 1.2 psn × 1200 times | 1,440,000 psn/Hr 1 psn × 36000 times × 40 lane |
| construction cost | '97 year constancy price | 60 million/km | 15 million/km | 10 million/km |
| construction period | 30 km construction | 3~8 year | 0.5~2 year | 0.3~1 year |
| accessibility | distance to the nearest station | 500 m | 400 m | 300 m |
| capacity variable cross section | center: outskirt cross section | impossible = railway 10 × 10 = 100 $m^2$ | impossible = 1 lane 4 × 5 = 20 $m^2$ | possible = 2~60 lane 3~100 $m^2$ |
| ticket price | price/10 km | 500 won | 1,000 won | 200 won |

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A guideway transit system comprising:

a main guideway having two floors including upper and lower floors with opposite traveling directions;

said main guideway being connected to an intersecting main guideway through a three-way intersection or a four-way intersection, with each main guideway having a ceiling and a plurality of lanes and vehicles traveling along both main guideways and the intersections under the control of a management computer system;

said three-way and four-way intersections are connected to a plurality of sub-guideways; and a plurality of terminals installed in locations connected to the sub-guideways and on the main guideways, whereby passengers are able to board or get off the vehicles only at said plurality of terminals connected to the sub-guideways.

2. A guideway transit system according to claim 1, wherein said terminals include:

a plurality of elevation platforms arranged parallel to each other;

a U-turn area arranged in the rear of each of said elevation platforms; and an entrance and exit path for vehicles arranged in the front of said elevation platforms.

3. A guideway transit system according to claim 1, wherein said four-way intersection comprises:

two sub-guideways each having a two-floor structure;

four arcuate ramps each having a two-floor structure; wherein upper and lower floors of each of two opposite ramps of said four arcuate ramps respectively cross each other.

* * * * *